US005197295A

United States Patent [19]

Pundak

[11] Patent Number: 5,197,295

[45] Date of Patent: Mar. 30, 1993

[54] STIRLING MINIATURE INTEGRAL COOLER/DEWAR ASSEMBLY

[76] Inventor: Nachman Pundak, Kibbutz Eyn Charod, Israel

[21] Appl. No.: 786,820

[22] Filed: Nov. 4, 1991

[51] Int. Cl.[5] ..... F25B 9/00

[52] U.S. Cl. ..... 62/6; 60/520; 250/352

[58] Field of Search ..... 62/6; 60/520; 250/352

[56] References Cited

U.S. PATENT DOCUMENTS

| | | | |
|---|---|---|---|
| 3,650,118 | 3/1972 | O'Neil | 62/6 |
| 3,969,907 | 7/1976 | Doody | 62/6 |
| 4,044,567 | 8/1977 | Dix et al. | 62/6 |
| 4,769,997 | 9/1988 | Pundak | 62/6 |
| 4,825,660 | 5/1989 | Okumura | 62/6 |
| 4,852,356 | 8/1989 | Unger et al. | 62/6 |

*Primary Examiner*—Ronald C. Capossela

*Attorney, Agent, or Firm*—Jacobson, Price, Holman & Stern

[57] ABSTRACT

A double stage Stirling cryogenic cooler with an IR Focal Plane array detector directly mounted on top of the cooler's expander second stage and with the radiation shield assembly mounted and cooled by the expander first stage to a temperature range of 200–100 K.

1 Claim, 1 Drawing Sheet

STIRLING MINIATURE INTEGRAL COOLER/DEWAR ASSEMBLY

FIELD OF INVENTION AND ITS BACKGROUND

The present invention relates to closed cycle cooling systems and more particularly to miniature Stirling type coolers as used to cool Infra Red detectors.

At present one of the trends in the Infra Red Thermal Imaging field is towards an electronically scanned system based on a Focal Plane Array of Infra Red detectors. These detectors have to be cooled to cryogenic temperature in order to maintain optimal signal to noise ratio.

Such Infra Red detectors are known as Focal Plane Array (FPA) detectors and are characterised by their relatively large size and thermal mass than the traditional discrete element detectors.

In order to isolate these detectors as much as possible from any IR radiation source rather than the desired field of view, the detector area must be surrounded by a cooled radiation shield assembly which contains the aperture and in some cases cooled optical elements like filters, lenses, etc. This assembly has to be cooled to 100°-200° K in order to reach a suitable effectivity and for all practical purposes does not have to be cooled to the same temperature as the FPA detector assembly.

The geometrical size of the detector assembly and the optical requirements dictate the size and the thermal mass of the radiation shield assembly.

In this type of detectors the cool down time requirements dictate the cooler's cooling power (and directly its size, weight and input power) rather than the actual heat load.

The cool down time is directly proportional to the the total thermal mass to be cooled to the cryogenic temperature of a given cooler. The only option to achieve rapid cool down time of a given detector assembly to a given operational temperature is:

1. By reduction of the detector assembly thermal mass,
2. By reducing the temperature span of the cooled components, or:
3. By enlarging the cooler's cooling power.

The cooling power of a typical Stirling cooler is directly proportional to its input power and indirectly to its size and weight.

OBJECTS OF THE INVENTION

It is thus the primary object of this invention to provide a combination of miniature cryocooler/dewar, specially designed for Infra Red Focal Plane Array - FPA - detectors.

It is a further object of the present invention to minimise the cooler input power, weight, size and to maintain rapid cool down time.

It is thus proposed to reduce the heat load and thermal mass by mounting the detector assembly directly on the cooler cold finger. The proposed cooler is a double stage integral Stirling type where the radiation shield-/cold optics assembly is mounted on the 100° K-200° K cooled first stage rather than to the 70° K-100° K cooled second stage where the detector assembly is mounted.

This unique approach allows minimization of input power, size and weight while fast cool down time is achieved.

This miniaturization is specially attractive to manportable "out of lab" systems where the weight, size and input power are the major concerns. At the moment no alternative cooling method having similar characteristics is available or under development.

SUMMARY OF INVENTION

According to the invention, there is provided a novel construction of the cooler/dewar assembly, the cooler being of a double stage Stirling type, the detector array being directly mounted to the cooler's second stage expander and the radiation shield assembly being mechanically and thermally ground to the cooler's expander first stage.

As stated, the detector's array is directly mounted and thermally grounded to the cooler's second stage and the radiation shield assembly is thermally and mechanically grounded to the cooler's expander first stage and cooled to a temperature range of 100° K-200° K. All cooled components are designed towards minimization of thermal and mechanical masses.

SHORT DESCRIPTION OF DRAWINGS AND PREFERRED EMBODIMENT

The invention will now be described with reference to the annexed drawings.

Figure 1:
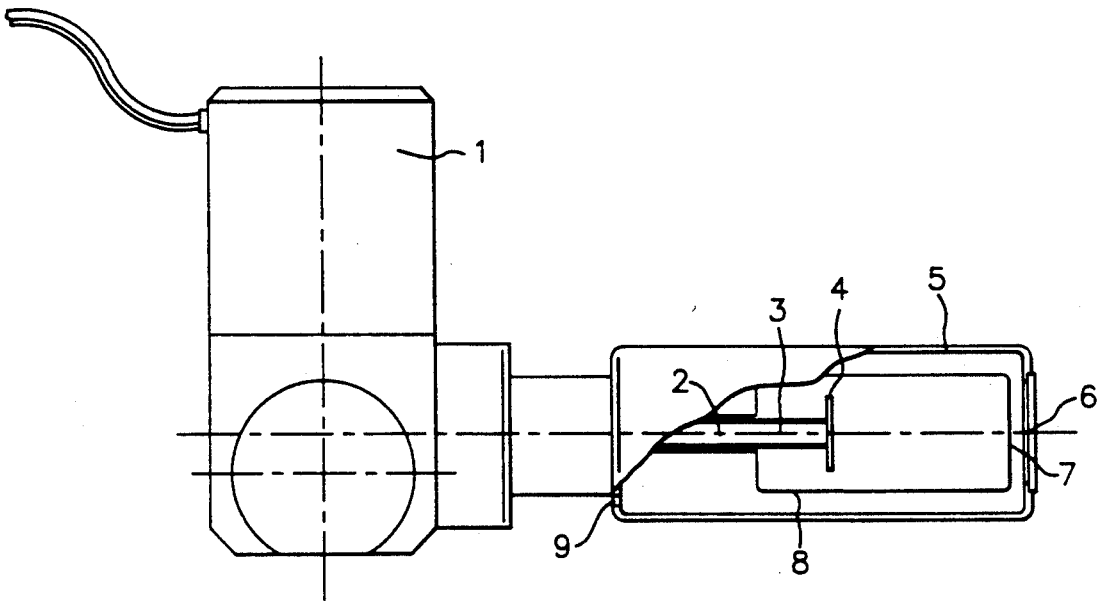
FIG. 1 is a side view of the assembly.
Figure 2:
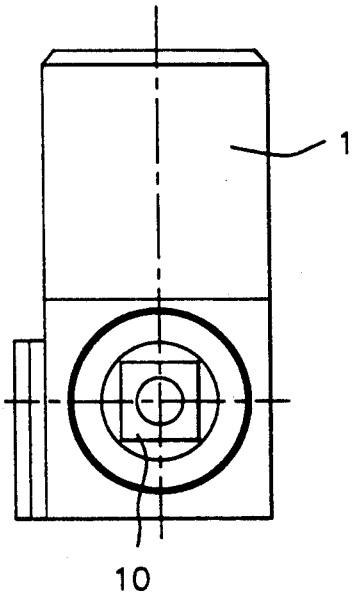
FIG. 2 is an end view thereof.
Figure 1:
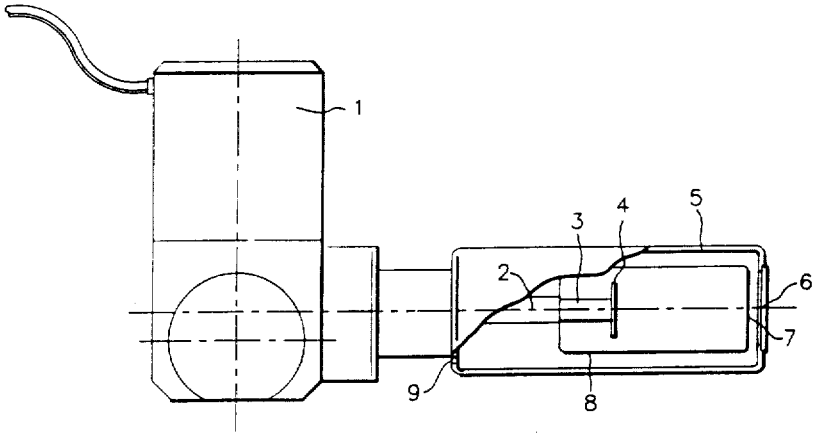

The Stirling cryocooler comprises a body 1 and a first stage expander 2 of the cryocooler, a second stage expander section 3 and a detector's array carrier 4. A dewar vacuum envelope 5 and the frontal window 6, the cold shield aperture 7 and cold shield 8. Multipins electrical feedthrough into the dewar vacuum envelope 9 and a IR Focal Plane Array 10.

It will be seen that only the IR Focal Plane Array and its mounting carrier are to be cooled to the detector operational temperature. The cooler's expander first stage provides thermal and mechanical ground to the larger thermal mass of the radiation shield assembly at a higher absolute temperature. This arrangement reduces significantly the total thermal inertia of the cooled parts and allows faster cool down time. Moreover, this concept improves the expander/detector assembly mechanical stiffness which is crucial for high image quality.

I claim:

1. A cryogenic Stirling two stage cooler for cooling of focal plane array type infra red sensors, said cooler comprising:

a first stage, a second stage expander, a detector assembly directly mounted on top of the second stage expander, and a radiation shield assembly mechanically mounted and thermally grounded to the first stage.

* * * * *

UNITED STATES PATENT AND TRADEMARK OFFICE

CERTIFICATE OF CORRECTION

PATENT NO. : 5,197,295

DATED : March 30, 1993

INVENTOR(S) : Nachman Pundak

It is certified that error appears in the above-indentified patent and that said Letters Patent is hereby corrected as shown below:

The title page, should be deleted to be replaced with the attached title page.

The drawing sheet, consisting of Fig. 1, should be deleted to be replaced with the drawing sheet, consisting of Figs. 1, as shown on the attached page.

Signed and Sealed this

Twenty-ninth Day of March, 1994

*Attest:*

Bruce Lehman

BRUCE LEHMAN

*Attesting Officer*

*Commissioner of Patents and Trademarks*

US005197295A

United States Patent [19]

Pundak

[11] Patent Number: 5,197,295

[45] Date of Patent: Mar. 30, 1993

[54] STIRLING MINIATURE INTEGRAL COOLER/DEWAR ASSEMBLY

[76] Inventor: Nachman Pundak, Kibbutz Eyn Charod, Israel

[21] Appl. No.: 786,820

[22] Filed: Nov. 4, 1991

[51] Int. Cl.[5] ..... F25B 9/00

[52] U.S. Cl. ..... 62/6; 60/520; 250/352

[58] Field of Search ..... 62/6; 60/520; 250/352

[56] References Cited

U.S. PATENT DOCUMENTS 3,650,118 3/1972 O'Neil ..... 62/6
3,969,907 7/1976 Doody ..... 62/6
4,044,567 8/1977 Dix et al. ..... 62/6
4,769,997 9/1988 Pundak ..... 62/6
4,825,660 5/1989 Okumura ..... 62/6
4,852,356 8/1989 Unger et al. ..... 62/6

*Primary Examiner*—Ronald C. Capossela
*Attorney, Agent, or Firm*—Jacobson, Price, Holman & Stern

[57] ABSTRACT

A double stage Stirling cryogenic cooler with an IR Focal Plane array detector directly mounted on top of the cooler's expander second stage and with the radiation shield assembly mounted and cooled by the expander first stage to a temperature range of 200-100 K.

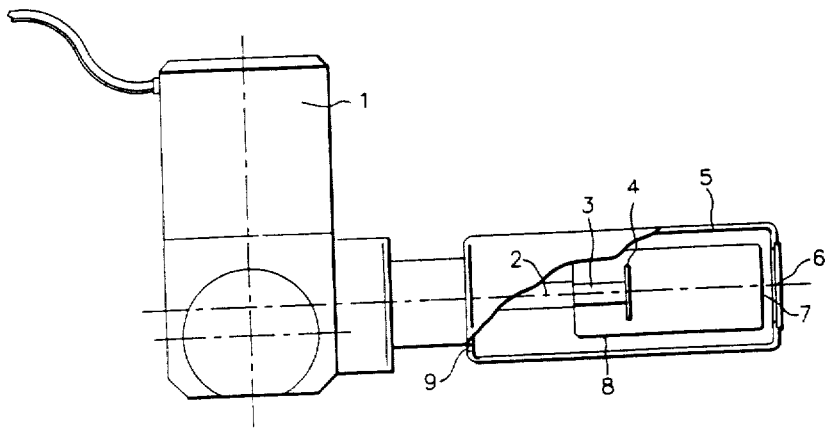

1 Claim, 1 Drawing Sheet